US008922599B2

(12) United States Patent
Lai

(10) Patent No.: US 8,922,599 B2
(45) Date of Patent: Dec. 30, 2014

(54) ORGANIC LIGHT EMITTING DIODE BASED DISPLAY AGING MONITORING

(75) Inventor: Jackson Chi Sun Lai, Mississauga (CA)

(73) Assignee: BlackBerry Limited, Waterloo, Ontario (CA)

( * ) Notice: Subject to any disclaimer, the term of this patent is extended or adjusted under 35 U.S.C. 154(b) by 169 days.

(21) Appl. No.: 13/592,602

(22) Filed: Aug. 23, 2012

(65) Prior Publication Data

US 2014/0055500 A1 Feb. 27, 2014

(51) Int. Cl.
*G09G 3/30* (2006.01)
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS

| | | | | |
|---|---|---|---|---|
| 6,337,542 | B1 | 1/2002 | Hanaki et al. | |
| 7,868,857 | B2 | 1/2011 | Nathan et al. | |
| 2004/0150590 | A1 | 8/2004 | Cok et al. | |
| 2006/0273997 | A1 | 12/2006 | Nathan et al. | |
| 2007/0103411 | A1 | 5/2007 | Cok et al. | |
| 2008/0055210 | A1 | 3/2008 | Cok | |
| 2008/0204438 | A1* | 8/2008 | Song et al. | 345/207 |
| 2008/0218453 | A1 | 9/2008 | Miyamoto et al. | |
| 2009/0174628 | A1* | 7/2009 | Wang et al. | 345/76 |
| 2010/0225634 | A1 | 9/2010 | Levey et al. | |
| 2011/0199395 | A1 | 8/2011 | Nathan et al. | |
| 2012/0262436 | A1* | 10/2012 | Yang | 345/211 |

FOREIGN PATENT DOCUMENTS

| | | |
|---|---|---|
| EP | 0923067 A1 | 6/1999 |
| WO | 2005057544 | 6/2005 |

OTHER PUBLICATIONS

Extended European Search Report dated Oct. 23, 2012 for EP 12181595.5.

* cited by examiner

*Primary Examiner* — Alexander S Beck
*Assistant Examiner* — Neil Wood
(74) *Attorney, Agent, or Firm* — Jeffrey N. Giunta; Fleit Gibbons Gutman Bongini & Bianco PL

(57) ABSTRACT

A multiple pixel display driving system and method. A display generator displays a plurality of images on a multiple pixel display. An aging monitor determines values of total electrical current consumed by the multiple pixel display while displaying the images, and determines electrical current value differences between baseline electrical currents total electrical currents associated with a test pattern image. A plurality of pixel aging characterization values indicating decreases in electrical current consumed by a pixels of the display is determined, and a display aging compensation matrix representing values by which pixel intensity values are to be compensated is determined based on the pixel aging characterization values.

25 Claims, 7 Drawing Sheets

ORGANIC LIGHT EMITTING DIODE BASED DISPLAY AGING MONITORING

FIELD OF THE DISCLOSURE

The present disclosure generally relates to electronic displays, and more particularly to monitoring degradation of elements within organic light emitting diode based displays.

BACKGROUND

Advancements in the design of Organic Light Emitting Diode (OLEDs) displays, such as Active Matrix OLED (AMOLED) displays, have resulted in an increase in the variety of applications that incorporate such display technology. Unlike many other types of conventional backlit LCD designs, AMOLED devices include light emitters in each individual pixel and require no backlight. These individual pixels emit light with intensity proportional to the electrical current supplied to the in-pixel OLED device. This OLED current ($I_{OLED}$) is controlled by circuits associated with each pixel, which may include one or more thin film transistor. (TFT).

AMOLED displays inherently degrade upon prolonged usage. AMOLED displays typically contain in-pixel circuit algorithms to compensate for transistor and OLED material degradation. These in-pixel algorithms are optimized for panel performance (luminance, spatial uniformity, etc) and reliability. However, the limits of compensation provided by these in-pixel circuit algorithms can be reached after prolonged and continuous usage. Once these limits are reached, the optical performance of the display reduces and is able to cause the panel to be un-usable or to at least fail out of specification.

The TFT devices generally implement an algorithm that is applied to externally supplied image data to supply the OLED element with an $I_{OLED}$ that results in the desired grayscale level for that pixel. The TFT configuration that applies this algorithm is referred to as an "in-pixel compensation circuit." The performance of the TFT components of a display commonly exhibit variations over time, variations relative to different locations across the display, or both. Degradation of OLED device elements themselves includes decreases over time of both turn on voltage (VF) and quantum efficiency (QE). The effect of the combination of the degradation of the TFT components and OLED components results in both a temporal and a spatial degradation in optical performance for the display. This composite degradation is referred to as "OLED panel aging". OLED panel aging results in optical luminance degradation that is spatially, temporally, and content dependent.

Therefore, the long term usability and performance of a display is able to be improved by an efficient technique that spatially monitors, i.e., across the pixels of a display, the actual performance degradation of a display over time to produce display aging compensation coefficients that are used to compensate grayscale data supplied to each pixel of the display.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
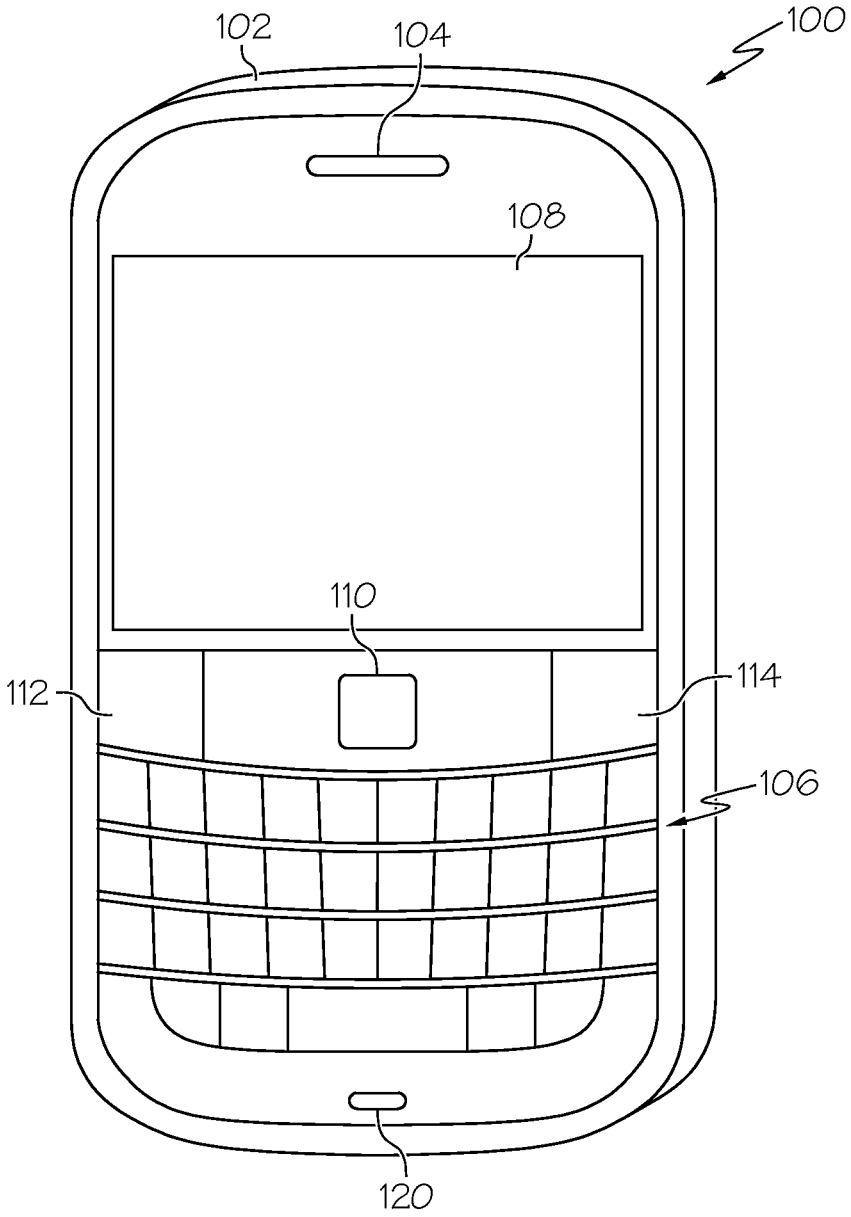
FIG. 1 illustrates a handheld communications device, according to one example.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the disclosed subject matter in virtually any appropriately detailed structure and function. Further, the terms and phrases used herein are not intended to be limiting, but rather, to provide an understandable description.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes hardware, software or a combination of hardware and software that is adapted to, set up, arranged, built, composed, constructed, designed or that has any combination of these characteristics to carry out a given function. The term "adapted to" describes hardware, software or a combination of hardware and software that is capable of, able to accommodate, to make, or that is suitable to carry out a given function.

The below described systems and methods allow characterization of pixel performance degradation due to aging in displays that include pixels that consume electrical current where the relationship between pixel electrical current consumption and the pixel intensity value driving pixels in the display changes over age. An aging compensation matrix is determined that defines compensation values to be applied to image pixel intensity values to compensate for the characterized performance degradation of the pixels in the display. In the examples described below, circuits providing image data to the display are able to use the aging compensation matrix to modify the value of pixel intensity data to compensate for the decrease in light output as a function of pixel intensity command that occurs as the display ages.

In the case of Active Matrix Organic Light Emitting Diode (AMOLED) displays, each pixel is driven with a desired light emission intensity value for that pixel, which is usually provided in the form of a voltage driving the individual pixel. In an example, each pixel has an element, such as a thin film transistor (TFT), that converts the voltage level representing pixel intensity into a current level that drives the organic light emitting diode (OLED) element that is part of that pixel. As the display ages, the performance of the pixel degrades in a manner that results in a decrease in the value of the electrical current passing through the OLED element when the pixel is driven with the same light emission intensity voltage. In general, this causes the pixels of the display "dim" with age when the display is displaying a particular image.

As used herein, the term "pixel performance degradation" relates to a decrease in emitted light intensity of a pixel that occurs over time when that pixel is driven by a fixed intensity command. In OLED displays, the emitted light intensity of a pixel is generally proportional to the electrical current consumed by the pixel. Therefore, in the example of an OLED display, the performance degradation of a pixel is able to be measured by a decrease in electrical current consumption by the pixel when the pixel is commanded to emit the same intensity level.

The below described examples operate to determine the decrease in electrical current consumed by each pixel for a given pixel intensity command. The performance degradation of the pixels in a display is able to vary at different locations across the display. The below described examples do not include additional circuitry in the pixels of the display, or on the data or select lines of the display, to determine the performance degradation of pixels in the display. To characterize the pixel performance degradation of a display at a particular time, the below described examples measure the total electrical current consumed by the display at that particular time, which is referred to herein as a measured total electrical current consumption, while the display is displaying each test pattern image within a number of test pattern images. A respective baseline total electrical current consumption value for the display that is associated with each test pattern image is also determined A respective baseline total electrical current consumption value that is associated with a respective test pattern image is the value of electrical current consumed by the display when displaying that respective test pattern image and when the display is in a particular state of aging. In one example, the baseline total electrical current consumption values correspond to electrical current consumption of the display when displaying the test pattern images when the display is new and un-aged. In further examples, the baseline total electrical current consumption values are able to correspond to any aged state of the display or its component pixels. In various examples, the baseline total electrical current consumption is determined by: retrieving a previously measured value, calculating a value based upon baseline performance data for each pixel, or by other techniques. In the following examples, the difference between the respective baseline total electrical current consumed by the display and the respective value of measured total electrical current consumed by the display for each test pattern image is attributed to the performance degradation of the pixels in the display, and used to determine aging compensation values for the pixels.

The following examples determines differences, for a number of test pattern images, in total electrical current consumption of a display over time and mathematically determines the difference in electrical current consumed by each pixel in the display based only on these differences in total electrical current consumption. The total electrical current consumed by the display is a summation of the electrical current consumed by each pixel in the display. For a display with "m" total pixels, the value of $i_{total}$, i.e., the total electrical current consumption of the display, is able to be represented as a sum of the electrical current consumption of each pixel, as can be represented by the following equation:

$$i_{total}=i_1+i_2 \ldots i_m,$$

where m=number of pixels in the display

In order to determine the electrical current consumed by the display, the below examples display a number of test pattern images and measures the total electrical current consumed by the display while displaying each of those test pattern image. As a display ages, each term in the above equation decreases due to the performance degradation of the pixels. The $i_{total}$ amount therefore decreases as well.

In the below described examples, a measured total electrical current consumption of the display while it is displaying a particular image is compared to a baseline total electrical current consumption associated with that image. The baseline total electrical current consumption associated with a particular image is able to be, for example, a measured electrical current consumption that is measured when that display, or a similar display, is new and is displaying that particular image. In various examples, the baseline current is able to be measured for each display device, is able to be measured for a batch or family of display devices, is able to be calculated based upon electrical current draw models derived for a display through various techniques, by other methods, or any combination of these techniques. In further examples, the baseline electrical current consumption is determined for a particular display at different times as the device ages. One or more of these measured electrical current consumption values for the "new" display or a similar display in one example is able to be stored in the device for future retrieval and comparison to measured current consumption by the display as the pixels age. In the following discussion, a "new" display refers to a display that has un-aged pixels. It is clear that as used below, the characteristics referred to as existing when a display is "new" are also able to refer to characteristics that exist when the display is at a particular age.

In a further example, the baseline total electrical current consumption associated with a particular image that is used for comparison with values of measured electrical current consumed by aged displays is able to be a theoretical total electrical current consumption that is calculated by applying a pixel intensity value of each pixel of an image to an electrical current consumption model for an un-aged pixel of the display. The modeled electrical current consumption of each pixel, given the intensity command for each pixel and the model of intensity command vs. electrical current, is then summed for each pixel to arrive at a baseline total electrical current consumption. In various examples, the modeled electrical current consumption for a pixel is empirically measured for a pixel of a display similar to this display, or the modeled electrical current consumption is able to be based on, for example, the electrical design of the pixel.

In various examples, values of baseline electrical current consumption data for an individual pixel of particular display are able to be determined by one or more techniques. One technique to determine baseline electrical current consumption data for an individual pixel is by reference to the design electrical design of the pixel components. An analysis of the electrical design and physical properties of components of a pixel will yield a theoretical electrical current consumption value for the pixel. Another technique averages electrical current consumption measurements that are made on a significant number of samples of similar displays. A further technique includes continuing to measure electrical current consumption of pixels of that particular display module over time.

In the below described examples, differences between the baseline total electrical current consumed by the display and the value of total measured electrical current are calculated for each test pattern image. These differences in total electrical current consumption by the display are attributed to decreases in electrical current consumption of pixels of the display due to aging. The differences between the baseline $i_{total}$ and the measured $i_{total}$ can be restated by substituting the above equation. This results in:

$$I_{total\text{-}baseline}-i_{total\text{-}measured}=\Delta i$$

$$\Delta i=(i_{1\text{-}baseline}-i_{1\text{-}measured})\ldots+(i_{m\text{-}baseline}-i_{m\text{-}measured})$$

$$\Delta i=(\Delta i_1)\ldots+(\Delta i_m)$$

Where: $\Delta i_1$ is the change of electrical current for the first pixel between the baseline state and the present, measured state.

$\Delta i_m$ is the change in electrical current for the $m^{th}$ pixel between the baseline state and the present, measured state.

One set of the above equations is able to be formed for each displayed test pattern image. In one example, the number of displayed test pattern images, and the number of electrical current value differences determined, is equal to the number of pixels in the display. This results in a number of the above equations that equals the number of pixels in the display. The change in electrical current consumption of each pixel is therefore able to be determined by solving that system of "m" equations to derive the "m" values of $\Delta i$. Because each pixel is driven with the same intensity level for a particular test pattern image, the change in electrical current for a particular pixel, e.g., the value of $\Delta i_x$ for the pixel "x," is able to be attributed to the performance degradation of the pixel due to aging.

In one example of the below processing, the percentage decrease of pixel electrical current consumption is assumed to be approximately constant for a wide range of pixel intensity values. Stated another way, if an intensity command for a full pixel intensity value is observed to have a ten percent (10%) decrease in electrical current for a pixel, then the electrical current decrease for other values of pixel intensity values is assumed to also be approximately ten percent (10%) for that pixel. This constant percentage relationship of pixel performance degradation for a wide range of pixel intensity values is applied in one example to determine an aging compensation matrix that includes a coefficient value for each pixel that is a reciprocal of the observed decrease in electrical current consumption of that pixel for a given pixel intensity value.

This relationship is based on the understanding that a percentage drop in emitted intensity of an OLED element is related to the intensity level at which the OLED element is operated and the amount of time that the particular OLED element is operated at that intensity. As in illustration, if one OLED element is observed to have, for example, a ten percent (10%) drop in intensity after being operated at a particular intensity level for a particular time duration, then the emitted intensity levels, and therefore the electrical current consumption, of all pixels will drop by the same percentage.

In some of the below described examples, the above described processing is performed by grouping pixels of the display into regions of the display. When characterizing the degradation of regions of pixels in the display, an aging correction matrix stores one correction factor that is to be applied to each pixel in the region. In characterizing the performance degradation of the pixels in the display, the processing is able to display test pattern images that effectively evaluate all or part of the pixels in the region. Several types of test pattern images are able to be used to characterize the degradation of regions of pixels in the display instead of each pixel in the display. Examples of such test pattern images include, for example, images that command an equal pixel intensity value for each pixel of each region, images that provide a non-zero pixel intensity value for one pixel or less than all pixels in the region while providing a zero pixel intensity value for the other pixels in each region, or any other type of test pattern image is able to be used. In characterizing the degradation of regions of pixels in the display, a processor is also able to use one of the above images or any arbitrary image and determine an average pixel intensity for each region and use that pixel intensity value to calculate a baseline electrical current for the display using the average intensity command for each region. In general, each region of the display is able to include contiguous pixels or non-contiguous pixel such that pixels of different regions are intermixed with one another. Further, the regions of the display are able to be all of equal size, or some of the different regions are able to be of unequal sizes. Such regions are also able to be rectangular, square, of any defined shape, or are able to not define any shape. In the following discussion, similar processing is used to determine the degradation of either each pixel of a multiple pixel display or of each region of pixels of the multiple pixel display. The term "respective group of at least one pixel" refers to either one respective pixel of the multiple pixel display, or of a respective region of pixels of the multiple pixel display.

The different test pattern images in the sequence of the number of test pattern images that are displayed as described above are able to define any image pattern. In various examples, some or all of the test pattern images in the number of test pattern images are able to have pixels that form an intensity gradient in one or two dimensions across the image. The different images are able to have, for example, one or more of: different gradient rates across the image, gradients that extend in different directions, or any other variations. In one example, the gradients are not monotonic, thereby allowing test pattern images to have various optical patterns that are not constrained. In general, the different test pattern images have different pixel intensity values for at least one pixel relative to the other test pattern images to allow for characterization of each pixel in the display.

FIG. 1 illustrates a handheld communications device 100, according to one example. The example handheld communications device 100 reflects an example of a portable electronic device 102, such as a Personal Digital Assistant (PDA), a smart-phone, a cellular telephone, a tablet computer, or any other type of portable electronic device. In general, a handheld device refers to any device that is sized, shaped and designed to be held or carried in a human hand. The portable electronic device 102 includes a wireless communications subsystem, described below, that is able to exchange voice and data signals. In one example, the wireless communications subsystem is able to receive a wireless signal conveying data tables to be displayed by the portable electronic device.

In one example, the handheld communications device 100 is an example of a device in which the systems and methods disclosed herein are able to be implemented. In one example, the handheld communications device 100 is a wireless two-way communication device with voice and data communication capabilities. Such electronic devices communicate with a wireless voice or data network via a suitable wireless communications protocol. Data communications allow the handheld communications device 100 to communicate with other computer systems via the Internet. Of variations of devices similar to the handheld communications device 100 include data messaging devices, two-way pagers, cellular telephones with data messaging capabilities, wireless Internet appliances or a data communication devices that may or may not include telephony capabilities.

The portable electronic device 102 includes an earpiece speaker 104 that is used to generate output audio to a user engaged in, for example, a telephone call. A microphone 120 is able to receive audible signals, such as a user's voice, and produce an electrical signal representing the audible signal. The portable electronic device 102 further includes a keyboard 106 that allows a user to enter alpha numeric data for use by, for example, application programs executing on the portable electronic device.

The portable electronic device 102 has a display 108. The display 108 depicted in FIG. 1 is an Active Matrix Organic Light Emitting Diode (AMOLED) graphical alpha numeric display capable of displaying various images to a user. The portable electronic device 102 is an example of an electronic display device, where the depicted display 108 is a multiple pixel display. In further examples, an electronic display device is able to be any electronic device with a display, where the electronic display device is able to be of any size and include hardware, software, or combinations of hardware and software to perform any processing that is able to be associated with presenting information on a multiple pixel display or that performs any other function.

The display 108 in one example is a touchscreen user interface device that allows a user to touch the screen of the display 108 to select items and to perform gestures, such as swiping a finger across the screen of the display 108, to provide a user interface input to an application program operating on the portable electronic device 102. In response to a user's gesture, such as swiping, or moving, a finger touching the screen of the display 108 across the screen, the display 108 receives a user interface input that is associated with the gesture performed by the user. The portable electronic device 102 further includes a display aging compensation component, such as is described herein, to provide aging compensation to images displayed on the display 108.

The portable electronic device 102 further has a first selection button 112 and a second selection button 114. In one example, a user is able to select various functions or select various options presented on the display 108 by pressing either the first selection button 112 or the second selection button 114. In another example, the first selection button 112 and the second selection button 114 are associated with particular functions that are performed in response to pressing the respective button. The portable electronic device 102 also has a trackpad 110. Trackpad 110 is able to receive input indicating a direction or movement, a magnitude of movement, a velocity of movement, or a combination of these quantities, in response to a user moving a finger across the face of trackpad 110.

In further examples, a user is able to use various techniques to provide inputs that are received by a processor of the portable electronic device 102. For example, microphone 120 is able to receive audible voice commands uttered by a user and process those audible voice commands to create an input signal that are received by other processes to control further processing. A user is also able to use keyboard 106 to enter text based commands that a processor of the portable electronic device 102 interprets to produce inputs that are received by other processes to control further processing.

Figure 2:
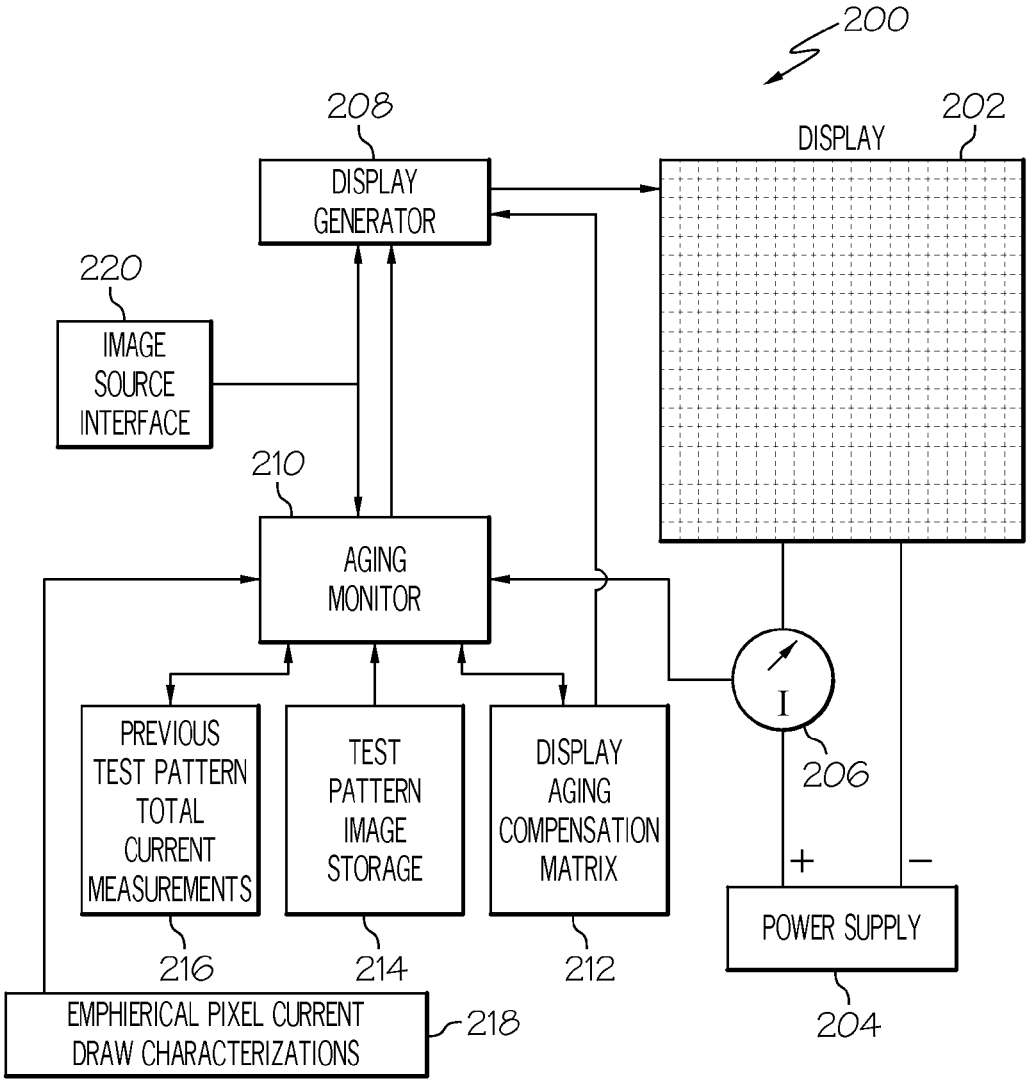
FIG. 2 illustrates an Active Matrix Organic Light Emitting Diode (AMOLED) display aging compensation system block diagram, according to one example.

FIG. 2 illustrates an Active Matrix Organic Light Emitting Diode (AMOLED) display aging compensation system block diagram 200, according to one example. The AMOLED display aging compensation system block diagram 200 is an example of an electronic display subsystem that receives data defining images, including sequences of images forming a video presentation, through an image source interface 220 and produces signals to drive an AMOLED display 202 to present images represented by the received data. As described below, the AMOLED display aging compensation system block diagram 200 includes an aging monitor 210 that operates to characterize performance degradation of pixels in the display 202 that occurs as the display 202 ages. Based upon the performance degradation characterizations of the pixels of the display 202, the aging monitor 210 determines a display aging compensation matrix 212. In one example, the display generator 208 modifies, based upon values in the display aging compensation matrix 212, data received by the image source interface 220 and relayed to the display generator 208 in order to generate data signals provided to the display 202. Modification of the data received through the image source interface 220 operates to compensate for performance degradations of pixels in the display 202 due to aging and therefore improves the quality of images displayed by the display 202 as it ages.

In various examples, the aging monitor 210 determines compensation values that are to be applied to respective groups of at least one pixel, which are able to consist of either each pixel of display 202, or of regions of pixels within display 202. The display 202 in some examples contains a large number of pixels, and the degradation of pixel performance is often not uniform across the area of the display 202. Pixel performance characteristics that degrade over time include, for example, the value of TFT and OLED element characteristics such as TFT threshold voltage ($V_T$), field effect effective mobility ($\mu_{EFF}$), and sub-threshold slope (SS), as well as OLED characteristics such as turn on voltage (VF) and quantum efficiency (QE). These pixel performance characteristics are able to degrade at different rates at different positions across the display 202. In order to better compensate for the aging of pixels in the display 202, the aging monitor 210 separately monitors the performance characteristics of pixels in different parts of the display 202.

In some examples, the aging monitor 210 characterizes the performance degradation of each pixel in the display 202 and determines a separate compensation parameter for each pixel in the display 202. In other examples, such as in some examples where the display 202 has a large number of pixels, the aging monitor 210 determines performance degradation characteristics for groups of pixels that are arranged as a number of defined regions of pixels. In one example, each region includes a number of contiguous, neighboring pixels. In an example of the aging monitor 210 that determines performance degradation characteristics for the pixels in a number of regions, all pixels in a particular region are treated as a single group of pixels and the degradation of all of the pixels in that particular region is characterized as a single unit. The aging monitor 210 in one example determines a corresponding correction value that is to be used for all of the pixels in that particular region based upon the characterized performance degradation of pixels in that particular region. In general, the change in pixel performance due to aging may not vary appreciably over small portions of a large display. A display generator 208 that compensates image data by applying a common compensation factor for all pixels in a particular region, where that compensation factor is determined based upon characterizing the performance degradation of pixels in that region, is able to provide acceptable long term display performance in some examples.

In some examples, the display 202 is a color display where each pixel in the display has a number of sub-pixels of different colors. In one example, display 202 includes three sub-pixels for each pixel where each pixel includes a red sub-pixel, a green sub-pixel, and a blue sub-pixel. In some examples, the aging monitor 210 measures performance degradation by treating all sub-pixels of each pixel as a group. When treating all sub-pixels as a group, the aging monitor 210 determines one corrector factor for each pixel and that correction factor is applied to all sub-pixels of that pixel. In further examples, the aging monitor 210 measures performance degradation of each sub-pixel and determines separate correction factors for each sub-pixel, where those separate correction factors are then applied to the data driving that respective sub-pixel. In further examples, subsets that consist of a number of pixels are able to be included in respective regions of pixels, where the performance degradation is characterized and compensation values are determined for all pixels within each region, as is discussed above.

The aging monitor 210 of one example measures performance degradation of pixels within the display 202 by sequentially providing data defining different test pattern images to the display generator 208. In some examples, the AMOLED display aging compensation system block diagram 200 maintains a test pattern images storage 214 that stores a number of test pattern images. In one example, each of these test pattern images specifies different grayscale levels for each pixel, or region of pixels. In one example, the number of individual test pattern images stored in the test pattern images 214 is equal to the number of pixels or regions for which performance degradation is characterized, and for which aging compensation factors are determined.

The aging monitor 210 of one example operates by monitoring the total amount of electrical current consumed by the display 202 when the display is being driven with each data set defining the respective test pattern image that is to be displayed. In one example, the display 202 is driven with signals to sequentially display a number of test pattern images and the electrical current consumed by the display 202 is measured by an electrical current meter 206. The aging monitor 210 receives values corresponding to the measured electrical current drawn during the time that each test pattern image is displayed.

In one example, the aging monitor 210 compares the measured electrical current drawn by the display 202 to a stored baseline electrical current associated with the particular test pattern image being displayed. In one example, the Active Matrix Organic Light Emitting Diode (AMOLED) display aging compensation system block diagram 200 includes a previous test pattern total current measurements storage 216 that stores one or more baseline electrical current values that are associated with each test pattern image. An example of a baseline electrical current value that is stored for each test pattern image is a measured electrical current drawn by display 202 when the display is new and its pixels have not aged. Another example of a baseline electrical current value that is stored for each test pattern image is a calculated value of the electrical current that is expected to be drawn by display 202 when displaying the test pattern image. The calculated value of the electrical current is determined in one example by analysis of the design of display 202 and the intensity of each pixel of the display when displaying that test pattern image.

In a further example, the aging monitor 210 operational images, which are images to be displayed on the display 202, are used as test pattern images. In this context, an operational image is an image that is produced by a component or source not associated with the AMOLED display aging compensation system block diagram 200, and is generally a stand-alone image or one or more images that form a video that a user desires to view. In general, image source interface couples to an external image source (not shown) and receives data defining operational images. The display generator 208, in turn, receives data defining operational images from the image source interface 220 and, based upon the data defining the operational images, produces data to drive the display 202 to property display the operational image. In one example that uses operational images as test pattern images, the data defining the respective operational images is also provided to the aging monitor 210. In some of those examples, data characterizing the electrical current consumption of new, un-aged display pixels is combined with the pixel intensity levels, e.g., the grayscale levels of the pixels of an operational image, to determine baseline electrical current consumption data for a new, un-aged display that is displaying the operational image.

In one example, an image is displayed on the display 202 by driving each pixel with a pixel intensity value, which is also referred to herein as a grayscale value. The data defining the image to be displayed in one example consists of a series of digital values for each pixel, where, for example, the grayscale level of each pixel is represented by eight (8) bits and is therefore able to have a value between zero (0) and two hundred and fifty-five (255). In general, the grayscale value reflects a voltage that is applied to a TFT transistor of that pixel, which sets a level of electrical current that flows through the OLED element of that pixel. As an OLED element ages, the electrical current that flows through the OLED element of that pixel decreases for a particular grayscale level driving that pixel. The light emitted by the OLED element of each pixel is correspondingly reduced as the pixel ages, requiring compensation to the intensity level driving that pixel if the pixel is to continue to emit the desired pixel intensity value.

In one example, the aging monitor 210 determines a difference between the present measured electrical current consumed by the display 202 when displaying a particular test pattern image and the baseline electrical current associated with that particular test pattern image. The aging monitor 210 in one example sequentially causes a number of test pattern images to be displayed and a difference is calculated between the measured electrical current drawn by the display while displaying each image and the baseline electrical current value associated with the corresponding test pattern image. One electrical current consumption difference is calculated and stored for each displayed image. This assembly of stored electrical current consumption differences is used, as is described in detail below, to characterize the performance degradation of each pixel, or groups of pixels, in the display 202. In this example, the performance degradation of each pixel is characterized by determining a decrease in electrical current that is consumed by that pixel when it is driven by a particular grayscale level. As is also described in detail below, a display aging compensation matrix 212 is determined based upon these assembled electrical current value differences and the grayscale image data for each test pattern image. This display aging compensation matrix 212 in one example stores a scaling factor for each pixel that is to be applied to the image grayscale level driving that pixel in order to cause that pixel to consume the same amount of current that a new, un-aged pixel would consume, and therefore emit the same level of light, when being driven by that grayscale level.

In one example, the data used to determine the aging compensation factors for each pixel or region of pixels is assembled into a vector or matrix form. Although the structure of pixels within display 202 are similar to a two dimensional matrix, the calculations of some examples described below that are used to characterize pixel performance degradation and to determine the aging compensation factors for each pixel or region of pixels arrange such values in a vector format. In such a structure, the vector consists of the value of the first row or column followed by the values of successive rows or columns. Although pixel aging characterization data is described below as being stored in a one dimensional vector, the aging compensation values for the pixels of a display 202 are able to be represented as a two dimensional aging compensation matrix where each row of pixels in display 202 has a corresponding row of values in the aging compensation matrix. Each of these rows has a number of values that equals the number of pixels in each row of pixels of the display 202. For example, a display that has 480 rows of 640 pixels each is able to be represented as a two dimensional matrix with 480 rows of 640 values each. Such a matrix has (480×640) or 307,200 values.

In the following description, the variable "m" indicates the total number of pixels, or regions of pixels, for which aging compensation factors are to be determined. In the example of a 480×640 display, m=307,200. In the following description, the variable "n" indicates the number of test pattern images that are displayed on the display 202 for which measurements of electrical current drawn by display 202 are made and recorded.

In one example, the aging monitor 210 creates a test pattern GrayScale (GS) definition matrix that stores the grayscale values of each pixel of the test pattern images. The test pattern GS definition matrix of one example is a two-dimensional matrix that has one column for each test pattern image. Each column of this test pattern GS definition matrix has "m" values or rows that contain the grayscale value defined for that pixel of that test pattern image. In a manner similar to that described above with regards to the aging compensation vector, each two dimensional test pattern image is represented as a respective vector in the test pattern GS definition matrix. As an illustration of the test pattern GS definition matrix, each test pattern is represented as a vertical vector, where each vertical vector contains on entry, or row, containing the grayscale value of its respective pixel. These vertical vectors are arranged as columns of the two dimensional test pattern GS definition matrix. An example of a test pattern GS definition matrix is:

$$GS \text{ Definition Matrix} = [GS] = \left[\begin{array}{c|c|c} i & i & i \\ m & m & m \\ a & a & \dots\ a \\ g & g & g \\ e_1 & e_2 & e_n \end{array}\right] = \begin{bmatrix} GS_{11} & GS_{21} & \dots & GS_{n1} \\ GS_{12} & GS_{22} & \dots & GS_{n2} \\ \vdots & \vdots & \vdots & \vdots \\ GS_{1m} & GS_{2m} & \dots & GS_{nm} \end{bmatrix}$$

In the above representation, the matrix consisting of several vertical vectors indicated as $image_1$, $image_2$ and $image_n$ illustrates the GS Definition matrix where vertical vectors represent the grayscale values of the n pixels of each test pattern image. The rightmost matrix depicts a two dimensional "n×m" matrix containing the individual "m' grayscale values of each of the "n" test pattern images. In the above GS Definition matrix:

$GS_{11}$ is the grayscale value of the first pixel of test pattern image 1.

$GS_{21}$ is the grayscale value of the first pixel of test pattern image 2.

$GS_{n1}$ is the grayscale value of the first pixel of test pattern image "n."

$GS_{12}$ is the grayscale value of the second pixel of test pattern image 1.

$GS_{22}$ is the grayscale value of the second pixel of test pattern image 2.

$GS_{n2}$ is the grayscale value of the second pixel of test pattern image "n."

$GS_{1m}$ is the grayscale value of the $m^{th}$ pixel of test pattern image 1.

$GS_{2m}$ is the grayscale value of the $M^{th}$ pixel of test pattern image 2.

$GS_{nm}$ is the grayscale value of the $M^{th}$ pixel of test pattern image "n."

Based on the above described grayscale information for the "n" images, the total electrical current drawn by the display 202 is able to be calculated based upon the electrical current consumed or drawn by each pixel in the display. In general, an OLED pixel has a non-linear relationship between the grayscale value at which the element is driven and the amount of electrical current that is consumed by the display pixel. Although the display pixel grayscale value to electrical current consumption relationship is non-linear, it is possible to linearize portions of the curve in a region that corresponds to variations of the relationship due to aging.

The total electrical current consumed by a display when displaying a particular image is able to be represented or calculated by using a linearized values of the display pixel grayscale value to electrical current consumption relationship. For a particular image, indicated in the below description as $image_r$, that has "m" pixels and that is displayed on a display with "m" pixels, the total current drawn by the display is able to be represented as:

$$i_1 = GS_{11} * C_1 + GS_{12} * C_2 + \dots GS_{1m} * C_m$$

where:

$i_1$ is the total electrical current drawn while displaying $image_1$, $GS_{11}$, $GS_{12}$, and $GS_{1m}$ are the grayscale values of each of the "m" pixels, $C_1$, $C_2$, and $C_m$ are the linearized value of the display pixel grayscale value to electrical current consumption relationship in the vicinity of the value of its respective grayscale (GS) value.

In one example, the aging monitor 210 stores, for each test pattern image, a baseline electrical current value that represents the value of electrical current consumed by the display when displaying that test pattern image. The baseline electrical current value for a particular image is dependent upon the grayscale value of each pixel in the text pattern image and each test pattern image is typically associated with a different baseline electrical current value. The baseline electrical current value is able indicate the electrical current consumed by the display when the display is new and no pixel aging has occurred. In various examples, the baseline current is able to be measured for each display device, is able to be measured for a batch or family of display devices, is able to be calculated based upon electrical current draw models derived for a display through various techniques, by other methods, or any combination of these techniques. In further examples, the baseline electrical current consumption is determined for a particular display at different times as the device ages.

Baseline electrical current measurements for a display are either stored, such as in the case of using defined and stored test pattern images stored in the test pattern image storage 214, or are calculated such as in the case of using arbitrary test pattern images. A previous test pattern total current measurements storage 216 stores baseline electrical current measurements in the case of using stored test pattern images. Calculation of baseline electrical current consumption of the display when displaying arbitrary test pattern images is based upon an algorithm that incorporates empirical pixel electrical current consumption characterization data for un-aged or aged pixels of the display being calibrated. These algorithms in one example utilize data stored in an empirical pixel electrical current consumption characterization storage 218.

The aging of the display 202 in one example is characterized by measuring the total electrical current consumption for the display 202 when displaying a number of images and comparing the measured total electrical current consumption to the baseline value, as described above, that is associated with the particular image. The total electrical current consumption is referred to below as a "present" consumption because it reflects the present current consumption of the display including the aging effects of the pixel elements of the display. Because OLED elements of each pixel in the display 202 have aged, the electrical current consumed by those OLED elements will decrease when being driven by the same grayscale value, which often correlates to the gate voltage of the TFT of that pixel. The operation of the aging monitor 210 determines the composite decrease in electrical current consumed by all pixels, i.e., the electrical current consumed by the entire display 202, for a number of test pattern images and solves for the electrical current consumption decrease of each pixel.

The electrical current consumption for the baseline condition is able to be represented as:

$$i_{1\text{-}baseline}=GS_{11}*C_{1\text{-}baseline}+GS_{12}*C_{2\text{-}baseline}+\ldots GS_{1m}*C_{m\text{-}baseline}$$

The measured present electrical current consumption is able to be represented as:

$$i_{1\text{-}measured}=GS_{11}*C_{11}*C_{1\text{-}measured}+GS_{12}*C_{2\text{-}measured}+\ldots GS_{1m}*C_{m\text{-}measured}$$

where:

$i_{1\text{-}baseline}$ is the total electrical current drawn while displaying $\text{image}_1$ for the baseline condition, $i_{1\text{-}measured}$ is the total electrical current drawn while displaying $\text{image}_1$, for the present measured condition, and $GS_{11}$, $GS_{12}$, and $GS_{1m}$ are the grayscale values of each of the "m" pixels, which are constant for both the baseline and present measured condition.

$C_{1\text{-}baseline}$, $C_{2\text{-}baseline}$, and $C_{m\text{-}baseline}$ are the linearized value of the display pixel grayscale value to electrical current consumption relationship for the baseline condition in the vicinity of the value of its respective grayscale (GS) value.

$C_{1\text{-}measured}$, $C_{2\text{-}measured}$, and $C_{m\text{-}measured}$ are the linearized value of the display pixel grayscale value to electrical current consumption relationship for the present measured condition in the vicinity of the value of its respective grayscale (GS) value.

The difference between $i_{1\text{-}baseline}$ and $i_{1\text{-}measured}$ is therefore:

$$\begin{aligned}i_{1\text{-}baseline}-i_{1\text{-}measured}=\Delta i_1&=(GS_{11}*C_{1\text{-}baseline}+GS_{12}*C_{2\text{-}baseline}+\ldots GS_{1m}*C_{m\text{-}baseline})-(GS_{11}*C_{1\text{-}measured}+GS_{12}*C_{2\text{-}measured}+\ldots GS_{1m}*C_{m\text{-}measured})\\&=GS_{11}(C_{1\text{-}baseline}-C_{1\text{-}measured})+GS_{12}(C_{2\text{-}baseline}-C_{2\text{-}measured})+\ldots GS_{1m}(C_{m\text{-}baseline}-C_{m\text{-}measured})\end{aligned}$$

$$\Delta i_1=GS_{11}*(\Delta C_1)+GS_{12}*(\Delta C_2)+\ldots GS_{1m}*(\Delta C_m)$$

In the above, the $\Delta C_x$ values are the differences in the pixel grayscale value to electrical current consumption relationship between the baseline and the present conditions. In one example, the aging monitor 210 attributes these changes to aging of display pixel components and uses this difference to characterize the aging of each pixel in the display 202. The $\Delta C_x$ values indicate the respective reduction in current flow through pixel "x" when that pixel is driven with a constant drive signal, represented by the associated GS value of that pixel in the test pattern image.

The above equations represent differences in the performance of the pixels of a display at different times when the display is provided with a particular test pattern image at different times. The above equations include "m" unknowns, namely the values of the "m" instances of $\Delta C_x$. These "m" unknowns reflect the "m" pixels in the display 202 that is being characterized. In order to solve for these "m" unknowns, the aging monitor 210 in one example uses the above equations with data for at least "m" different test pattern images, thereby allowing the aging monitor 210 to solve for these "m" unknown $\Delta C_x$ values. In further examples, more or fewer than "m" test pattern images are able to be used. When more than "m" test pattern images are used, the resulting over determined system of equations is able to be solved by various known techniques. When fewer than "m" test patterns are used, approximations or estimations of the values of the "m" $\Delta C_x$ values are able to be determined based upon various techniques or a priori information.

The processing to determine the aging compensation in one example characterizes performance degradation of each pixel or region of pixels by accumulating respective values of total electrical current that are consumed by the display 202 while displaying each test pattern image, and then combining the assembled respective values of total electrical current with displayed grayscale values for each pixel or region of pixels. In one example, as each test pattern image "k" is displayed on display 202, the measured total electrical current value associated with that test pattern image ($i_{k\text{-}measured}$) is subtracted from the respective baseline electrical current associated with that displayed test pattern image ($i_{k\text{-}measured}$) to determine an electrical current value difference ($\Delta i_k$) for that test pattern image. This subtraction is represented as:

$$\Delta i_k=i_{k\text{-}baseline}-i_{k\text{-}measured}$$

The corresponding electrical current value difference for each test pattern image is measured by the aging monitor 210 in one example and each of these values is stored in an electrical current value difference vector [Δi]. This vector is represented below:

$$[\Delta i]=[\Delta i_1 \Delta i_2 \ldots \Delta i_n]$$

Where $\Delta i_k$ is defined above.

The aging monitor 210 characterizes the performance degradation of each pixel or region of pixels based on the above described electrical current value difference vector [Δi] and the above described GS definition matrix [GS]. The aging characterization values in this example are able to be depicted as an aging characterization vector with "m" respective values, where each of the "m" respective values is an entry that corresponds to a respective pixel or region of pixels of the display 202. In the following the values of elements, or entries, of the aging characterization vector [A] are reflected as $A_x$, where the value of $A_x$ corresponds to the values of $\Delta C_x$ described above. The Aging Characterization Vector [A] is represented below as:

$$\text{Aging Characterization Vector}=[A]=[A_1 A_2 \ldots A_m]$$

Where $A_x$ is the aging characterization of the $x^{th}$ pixel of the display 202. In one example, $A_x$ is equivalent to the value $\Delta C_x$ described above.

In one example, the aging monitor 210 solves for the display aging characterization vector [A] by solving for the [A] matrix in the following matrix equation by using conventional techniques.

$$[\Delta i]=[A][GS]$$

The above matrix equation expresses an equality of the [Δi] vector, which is an electrical current value difference vector, and a matrix product of the [A] vector, which is the characterization vector described above, and the [GS] matrix, which is an intensity matrix that has an entry representing pixel intensity values of each pixel in each test pattern image. The above matrix equation expands to:

$$[\Delta i_1\ \Delta i_2\ \ldots\ \Delta i_n]=[A_1\ A_2\ \ldots\ A_m]\begin{bmatrix} GS_{11} & GS_{21} & \ldots & GS_{n1} \\ GS_{12} & GS_{22} & \ldots & GS_{n2} \\ \vdots & \vdots & \vdots & \vdots \\ GS_{1m} & GS_{2m} & \ldots & GS_{nm} \end{bmatrix}$$

Based on the above equations, it is clear that the values of $A_x$ represent a ratio between amount of electrical current consumed by display pixel "x" in the baseline conditions and in the present conditions when that display pixel is driven by a the same grayscale drive level GS. Stated differently, the values of Ax indicate a respective decrease in electrical current consumed by a respective pixel of the multiple pixel display. The relationship for a particular pixel "x" is able to be represented as:

$$GS_x*A_x*C_{x\text{-}baseline}=GS_x*C_{x\text{-}measured}$$

The differences in value between $C_{x\text{-}baseline}$ and $C_{x\text{-}measured}$ is assumed to be small enough that the dependence upon $C_x$ as a function of electrical current is able to be modeled as a linear relationship. Stated algorithmically:

$$C_x=S_x*i_x$$

Where $S_x$ is the slope of the $C_x$ function $i_x$ is the electrical current consumed by pixel x Given this linearization, $C_x(i)=S_x*i$, therefore, the difference in electrical current reflected by $\Delta C_x$ is able to be expressed as:

$$\Delta C_x=S_x*\Delta i$$

As noted above, $Ax=\Delta C_x$. Given the above described linearization, $A_x$ is proportional to Δi. Based upon these assumptions, the aging monitor 210 in one example assumes that adequate age compensation for a particular display element "x" is able to be performed by increasing the electrical current provided to the display element by a factor of $2/A_x$.

In one example, the display aging compensation matrix 212 is populated with values by which grayscale values of a matrix are multiplied in order to compensate for display aging. As discussed in detail below, the display aging compensation matrix 212 of one example has one pixel aging compensation value entry for each respective pixel of the "m" pixels contained in display 202. These "m" values in the display aging compensation matrix are set in one example to a value of $1/A_x$, where $1 \le x \le m$, and where $A_x$ is determined as described above.

The above described algorithm operates to determine, based on a number of electrical current value differences and pixel intensity values of pixels in each test pattern image, a number of pixel aging characterization values, where each pixel aging characterization value indicates a respective decrease in electrical current consumed by a respective group of at least one pixel of the multiple pixel display. Although the above description details an algorithm that processes the pixel intensity value of each pixel in each test pattern image, it is clear that a similar algorithm is able to be applied to a processing architecture where regions of pixels are grouped together into a number of subsets of pixels in the multiple pixel display, and the pixel aging characterization values characterize aging the respective subsets of pixels. In these various examples, the pixel aging characterization values are determined based in part on the pixel intensity values of pixels in each test pattern image. In one example, the pixel intensity values of pixels correspond to the pixel intensity values of all pixels in each test pattern image. In further examples that characterize regions of pixels where each region consists of a respective subset plurality of pixels within the multiple pixel display, the pixel intensity values of pixels consist of a representative pixel intensity value for each subset of pixels that comprise each region. Such representative pixel intensity values are able to be, for example, an average pixel intensity value for the subset of pixels, or any other representative value upon which the electrical current consumption by the subset of pixels in the region depends.

It is noted that ellipses, i.e., a three dot symbol " . . . " as is commonly understood by practitioners in the relevant arts, are used in the above description and equations indicate terms that are generally in the middle of a sequence. For example, the vector [A] is represented above as $[A_1\ A_2 \ldots A_m]$. In this example, the ellipses indicate the elements $A_3$ through $A_{m-1}$ in the sequence of elements of the vector [A].

Figure 3:
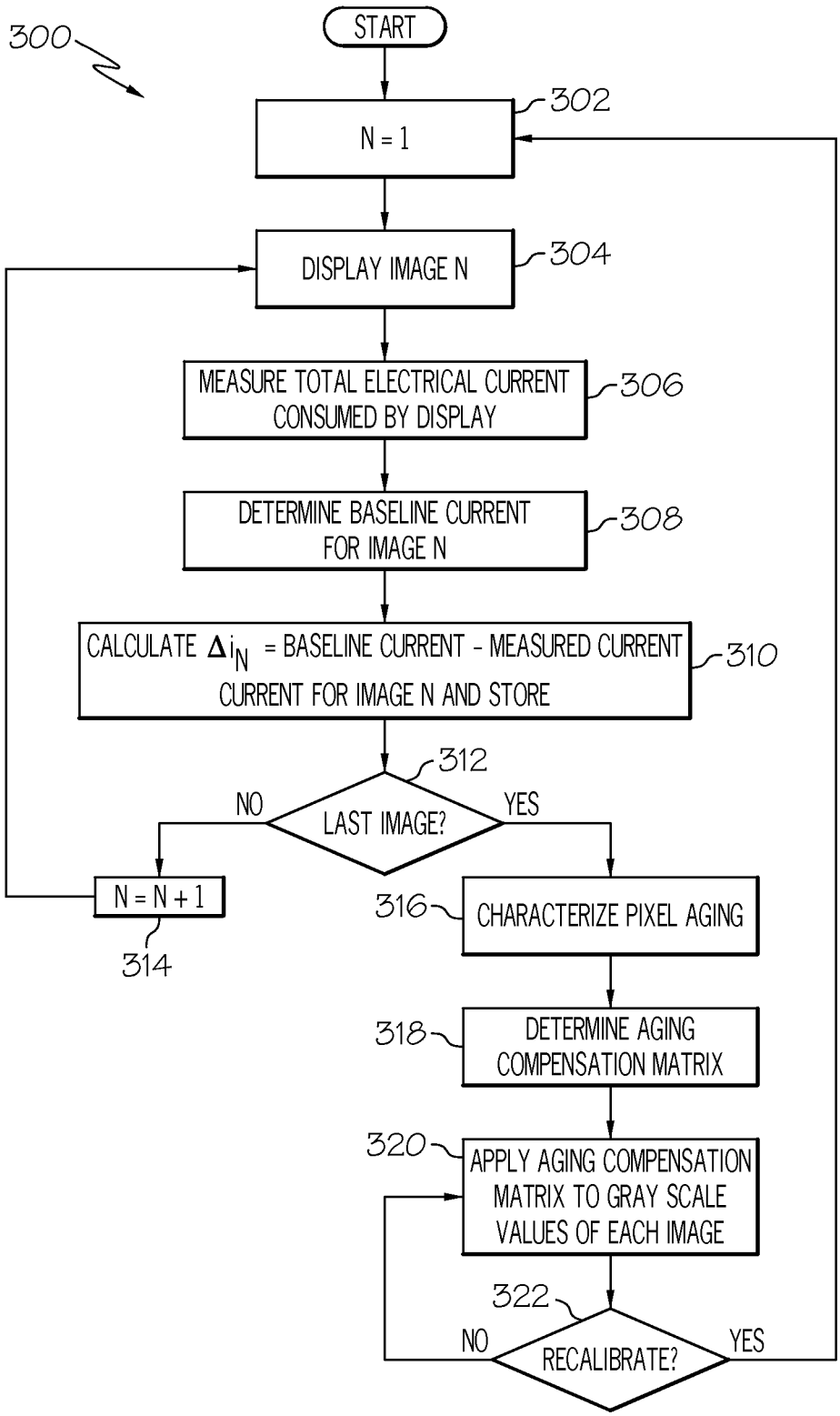
FIG. 3 illustrates a display aging compensation processing flow, according to one example.

FIG. 3 illustrates a display aging compensation processing flow 300, according to one example. The display aging compensation processing flow 300 is an example of a processing flow performed at least in part by the above described aging monitor 210 and that implements the above described processing to determine a display aging compensation matrix to be used to compensate image data for display pixel aging.

The display aging compensation processing flow 300 displays a number of test pattern images and measures the current consumed by the display when displaying each of the test pattern images. The display aging compensation processing flow 300 begins by setting, at 302, a value of "N," which is used as an index for the test pattern images to be displayed, to one (1). The display aging compensation processing flow 300 continues by displaying, at 304, test pattern image "N" on a display. The total current consumed by the display while displaying test pattern image "N" is measured, at 306. In one example, the total current consumed is measured by electrical current meter 206 as described above.

The display aging compensation processing flow 300 continues by determining, at 308, the baseline electrical current for image "N." As discussed above, the baseline electrical current for a particular test pattern image, such as image "N," is able to be determined by measurements of electrical current consumption by a display when an example display or this particular display is new, by calculations based on a display's design and other characterization data, by other techniques, or by combinations of these techniques. The baseline electrical current is able to be stored in, for example, non-volatile memory in association with each test pattern image. In examples where the baseline electrical current is stored, a processor is able to determine the baseline electrical current for a particular image by retrieving that data from the non-volatile memory.

The display aging compensation processing flow 300 continues by calculating, at 310, a value for $\Delta i_n$, which in one example is the difference between the baseline electrical current and the measured electrical current for the image N being displayed. In one example, the $\Delta i_n$ is stored in a vector for later processing.

The display aging compensation processing flow 300 continues by determining, at 312, if the displayed test pattern image, i.e., image "N," is the last test pattern image to be displayed. If the displayed image is not the last to be displayed, the value of "N" is incremented, at 314, and the display aging compensation processing flow 300 returns to displaying image "N," at 304.

If it is determined that the displayed image is the last test pattern image to be displayed, the display aging compensation processing flow 300 continues by characterizing, at 316, pixel aging. Characterizing pixel aging in one example is performed by solving for the display aging characterization vector [A] based upon the changes in total electrical current that is consumed by the display while displaying the sequence of test pattern images, as is described above. The display aging compensation processing flow 300 proceeds by determining, at 318, an aging compensation matrix based upon the characterized pixel aging. In one example, the aging monitor 210 creates a display aging compensation matrix 212 by storing the inverse of the values of the [A] matrix discussed above.

The display aging compensation processing flow 300 continues by applying, at 320, the display aging compensation matrix to grayscale values of each image to be presented on the display. With reference to FIG. 2 described above, the applying of the display aging compensation matrix includes the display generator 208 multiplying the grayscale values of images to be displayed by the values of the display aging compensation matrix 212.

The display aging compensation processing flow 300 then determines, at 322, if recalibration is to be performed. In one example, a device with a display is configured to perform recalibration on a schedule, which is able to be defined by number of hours that the display is operating. In further examples, an elapsed time since the last calibration, without regard as to whether the display is operating or not operating during that time period, is used to determine when to perform recalibration. In various examples, a determination to perform recalibration is able to be based upon any criteria. In the case of a determination that recalibration is not to be performed, the display aging compensation processing flow 300 returns to applying, at 320, the display aging compensation matrix. In the case of a determination that recalibration is to be performed the display aging compensation processing flow 300 returns to setting, at 302, the value of "N" to 1 and the display aging compensation processing flow 300 is continued as described above.

Figure 4:
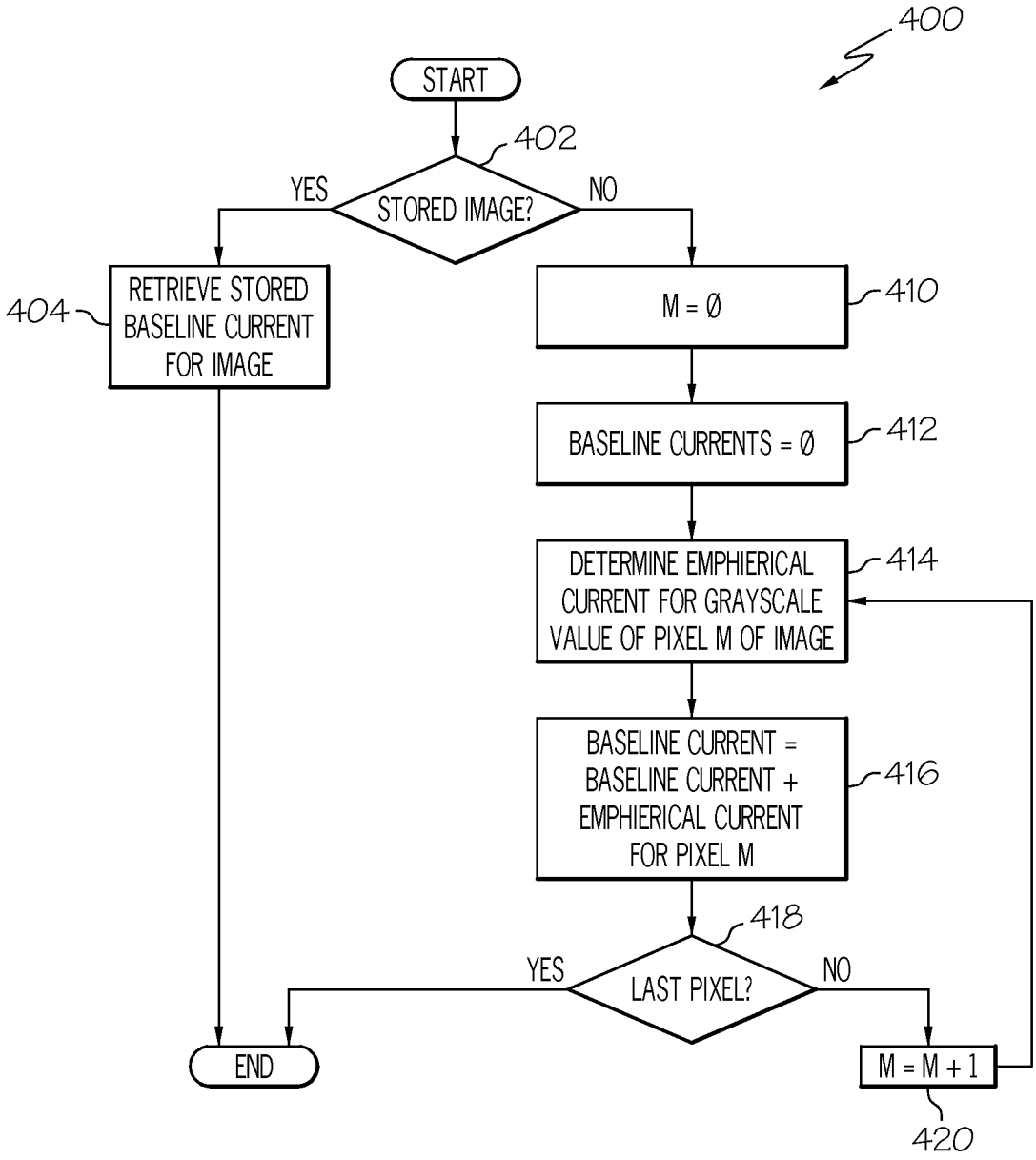
FIG. 4 illustrates a baseline electrical current determination process, according to one example.

FIG. 4 illustrates a baseline electrical current determination process 400, according to one example. The display aging compensation system of some examples use test pattern images that are defined and stored in a storage device, such as in the test pattern image storage 214, discussed above. In other example, so called "live" images, e.g., images that are received from an image source interface 220 and that are images to be displayed to a user on the display, are used as test pattern images. In some examples, combinations of these types of test pattern images are used.

The baseline electrical current values associated with defined test pattern images that are stored in a test pattern image storage are able to be stored in a suitable location and accessed by a processor, such as the aging monitor 210. In various examples, the baseline electrical current values are stored in the same storage with the test pattern images, or the baseline electrical current values are stored in a separate storage. In one example, the baseline electrical current values are able to also be calculated when those values are needed, instead of stored and retrieved as required.

The baseline electrical current determination process 400 begins by determining, at 402, if the particular test pattern image for which a baseline electrical current value is required is stored. In this example, if the test pattern image is determined to be a stored image, the baseline electrical current determination process 400 continues by retrieving, at 404, the stored baseline electrical current value for that particular image. The baseline electrical current determination process 400 then end.

If it is determined, at 402, that the particular test pattern image for which a baseline electrical current value is required is not stored, the baseline electrical current determination process 400 continues by calculating the baseline electrical current value for the particular test pattern image. In one example, a test pattern image that is not stored is able to be a "live" image that is received from an image source and is to be presented to the user. In the case of receiving an image that is not stored, no information about the image is able to be assumed. As described below, the baseline electrical current consumption of the display displaying an arbitrary test pattern image that is not stored is calculated based upon an algorithm that incorporates empirical electrical current consumption data for un-aged or aged pixels of the display being calibrated. The empirical electrical current consumption data is able to be expressed in, for example, a look up table, a mathematical algorithm, or other techniques. The values of the empirical electrical current consumption data are able to be determined by any suitable technique, such as measurements of a representative display or pixel device, measurements of the actual display or pixel device being calibrated, theoretical electrical current consumption for a particular grayscale value based upon an analysis of pixel circuits, any other suitable technique, or one or more combinations of these. The empirical electrical current consumption data is able to reflect the electrical current consumption of un-aged pixels in a display or the electrical current consumption of aged pixels.

If it is determined, at 402, that the particular test pattern image for which a baseline electrical current value is required is not stored, the baseline electrical current determination process 400 continues by setting, at 410, a value of "M" to zero. In this example, "M" indicates the particular pixel of the test pattern image being evaluated. The baseline electrical current determination process 400 continues by setting, at 412, a value of the baseline current to zero. The baseline electrical current determination process 400 continues by determining, at 414, an empirical electrical current value for the grayscale value of the $M^{th}$ pixel of the test pattern image. The baseline electrical current determination process 400 then accumulates, at 416, this determined empirical electrical current for the $M^{th}$ pixel into the stored baseline current value by adding this determined empirical electrical current to the stored baseline current.

The baseline electrical current determination process 400 then determines, at 418, if the $M^{th}$ pixel is the last pixel of the image being evaluated. If the $M^{th}$ pixel is not the last pixel, the baseline electrical current determination process 400 continues by incrementing, at 420, the value of M by one (1) and returning to determining, at 414, the empirical electrical current for the grayscale value of the $M^{th}$ pixel. If the $M^{th}$ pixel is last pixel of the test pattern image, the baseline electrical current determination process 400 terminates.

Figure 5:
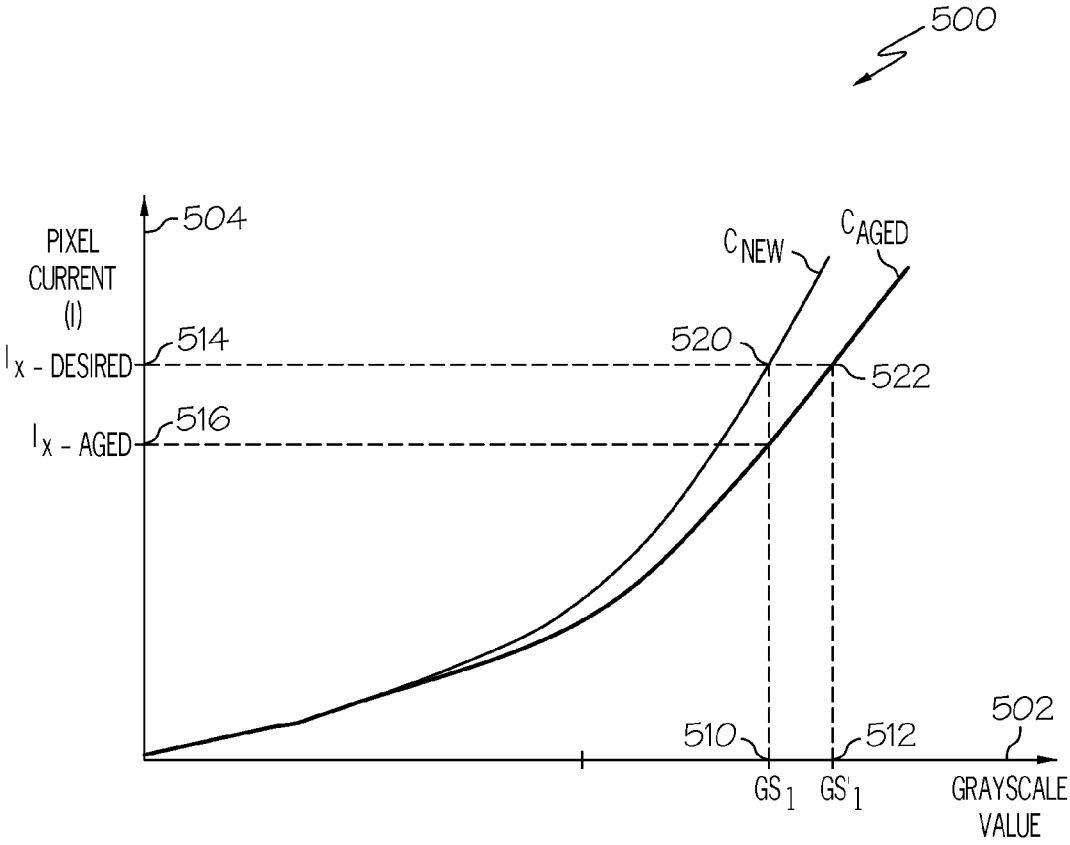
FIG. 5 illustrates pixel electrical current vs. grayscale value relationships, according to one example.

FIG. 5 illustrates pixel electrical current vs. grayscale value relationships 500, according to one example. The pixel electrical current vs. grayscale value relationships 500 depicts a horizontal grayscale value axis 502 and a vertical pixel electrical current axis 504. Two relationship curves are also depicted, a $C_{new}$ curve 520 and a $C_{aged}$ curve 522.

The $C_{new}$ curve 520 depicts the electrical current consumed by a pixel as a function of the grayscale value that is driving the pixel when the display is new and the pixel elements have not degraded by age. The $C_{aged}$ curve 522 depicts a similar relationship but for a pixel element with degraded performance due to age.

The grayscale value axis 502 of the pixel electrical current vs. grayscale value relationships 500 depicts two grayscale values, a $GS_1$ 510 and a $GS_1'$ 512. For the $GS_1$ 510 grayscale value, the electrical current consumed by a new, un-aged, pixel is determined by the intersection of the $GS_1$ 510 value with the $C_{new}$ curve 520. The electrical current consumed by the new, un-aged, pixel shown as $I_{x\text{-}desired}$ 514. This is the amount of current consumption that is desired to be caused by the $GS_1$ 510 grayscale value and results in the desired amount of light emission for that grayscale value.

As the display ages and the performance of the pixels degrade, the electrical current consumed by an aged pixel when it is being driven by a grayscale level equal to $GS_1$ 510 is determined by the intersection of the $GS_1$ 510 value with the $C_{aged}$ curve 522. The electrical current consumed by the aged pixel when driven by the $GS_1$ 510 grayscale level is shown as $I_{x\text{-}aged}$ 516, which is less than the value of $I_{x\text{-}desired}$ 514. The lower electrical current consumed by the aged pixel when being driven by the $GS_1$ 510 grayscale level value results in less light being emitted by the OLED element of that pixel that is desired, causing the displayed image to not appear as desired.

In order to cause the aged display to emit the desired light level for the $GS_1$ 510 grayscale level, the pixel of the aged display is driven with a grayscale level of $GS_1'$ 512, which is greater than the $GS_1$ 510 value. The amount of this increase is determined based upon the display aging compensation matrix 212. When the aged display element is driven with a grayscale value of $GS_1'$ 512, the electrical current consumed by the aged pixel is indicated by the intersection of the $GS_1'$ 512 level with the $C_{aged}$ curve 522, which is $I_{x\text{-}desired}$ 514.

Figure 6:
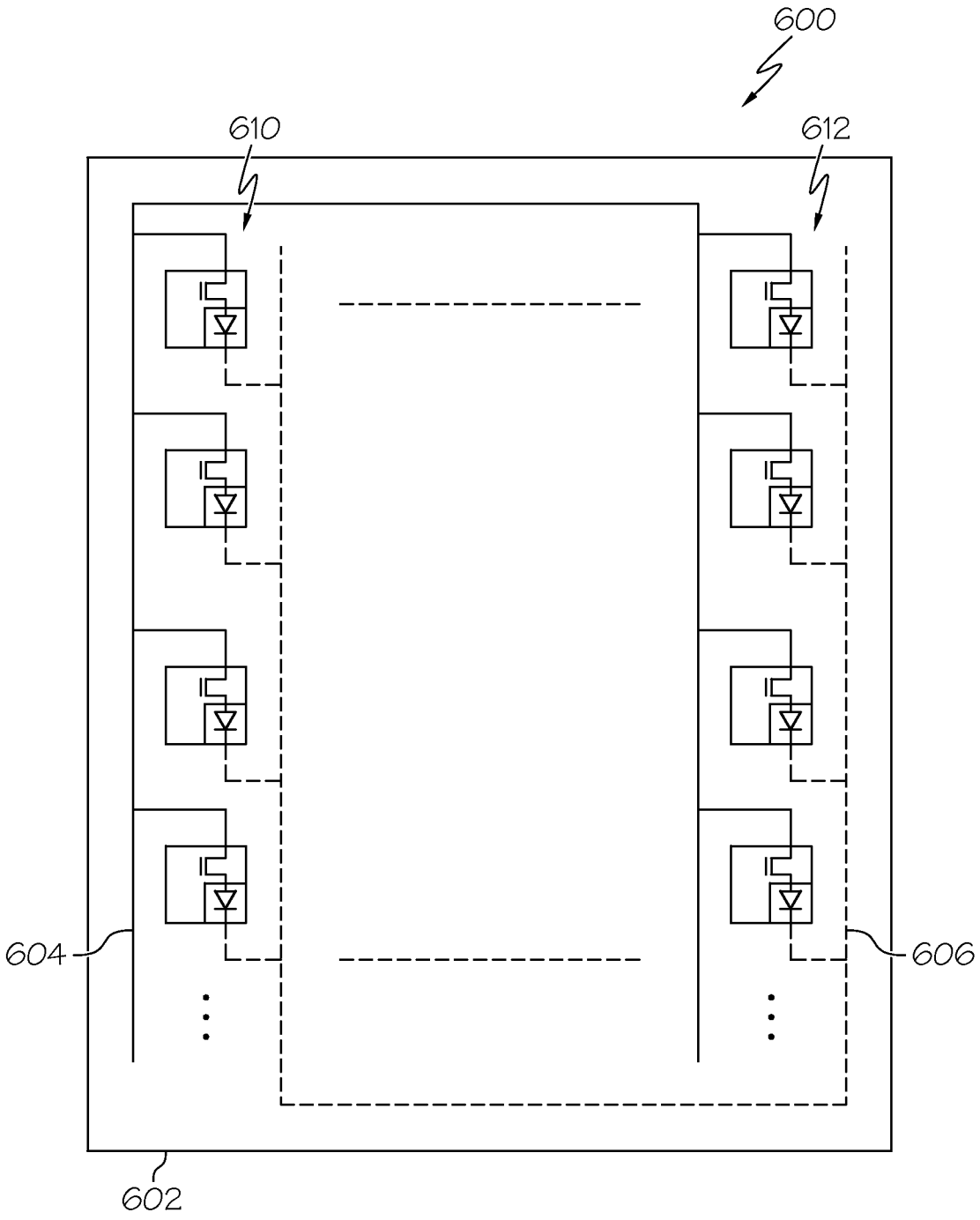
FIG. 6 illustrates an OLED panel pixel interconnection diagram, in accordance with one example.

FIG. 6 illustrates an OLED panel pixel interconnection diagram 600, in accordance with one example. The OLED panel pixel interconnection diagram 600 depicts a display 602 that has a EL_VDD line 604 and an EL_VSS line 606. The EL_VDD line 604 and EL_VSS line 606 are each a power rail conductor that is in contact with circuitry present at each pixel in the display 602. A first column of pixels 610 and a second column of pixels 612 are also depicted in the OLED panel pixel interconnection diagram 600 and represent the usually large number of pixels present in a display 602.

As is familiar to practitioners of ordinary skill in the relevant arts, each pixel is also in contact with conductors that convey image data and pixel programming selection in addition to the EL_VDD line 604 and the EL_VSS line 606. In general, the numerous pixels of display 602 are arranged in a matrix format. The above described processing characterizes the aging of each pixel in the display 602 and determines correction factors to be applied to the grayscale image data for each pixel in order to compensate for degraded performance of the pixels due to aging.

The electrical current consumed by the display 602 is generally measured as the electrical current that flows through the EL_VDD line 604 to the EL_VSS line 606. In other display designs, it is possible to measure electrical currents flowing into other display conductors to characterize display pixel degradation.

Figure 7:
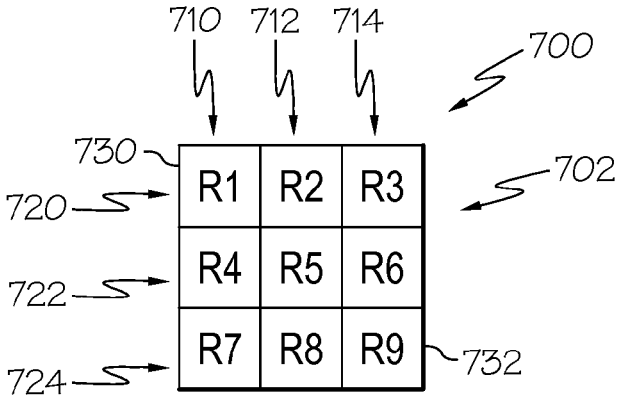
FIG. 7 illustrates a display region definition, according to one example.

FIG. 7 illustrates a display region definition 700, according to one example. The large number of pixels within a typical display is able to complicate the above described calculations to determine the aging vector [A]. The above described technique generally uses one test pattern image per pixel of the display being characterized. In such a scenario, characterizing the performance degradation of a large display with a large number of pixels involves displaying a correspondingly large number of test pattern images and the processing of correspondingly large matrices in the above described calculations.

In order to simplify the calculations and speed the data collection phase that include displaying a number of test pattern images, the processing of one example divides the display into a number of regions, where each region includes a contiguous group of display pixels. All pixels in a particular region in this example are treated as a single display element. For example, test pattern images in one example drive each pixel in a particular region with the same image data. In some cases, the pixel elements in a large display degrade differently at largely different positions on the display. For example, pixels on a right side of a display may age differently than pixels on the left side of the display. However, pixels that are close to one another are exposed to similar thermal profiles and often emit light at similar intensities, and therefore may age at a more similar rate than pixels that are farther apart. These operating characteristics are able to result in acceptable performance for a display aging compensation technique that divides a large display into regions and characterizes all pixels in a particular region as one unit.

The display region definition 700 depicts a display 702 that is divided into a three by three (3×3) array of regions. The display region definition 700 depicts a first column 710, a second column 712 and a third column 714. Similarly, a first row 72, a second row 722 and a third row 724 are also depicted. In various examples, all regions are able to be defined to have the same arrangement of pixels, or the different regions are able to have different sizes, different number of pixels, different aspect ratios, or any combination of these differences.

A first region 730 is shown in an upper left corner of display 702. A second region 732 is shown in a lower right corner of display 702. As discussed above, these two regions are located across the area of display 702 from one another, and therefore are likely to be exposed to different temperature profiles due to electronics or other components in a housing containing the display 702. The pixels within the first region 730, however, are likely to have similar temperature profiles and intensities over time, and are therefore likely to age similarly. The pixels in the second region 732 are also likely to age similarly, but at a different rate than those in the first region 730.

Figure 8:
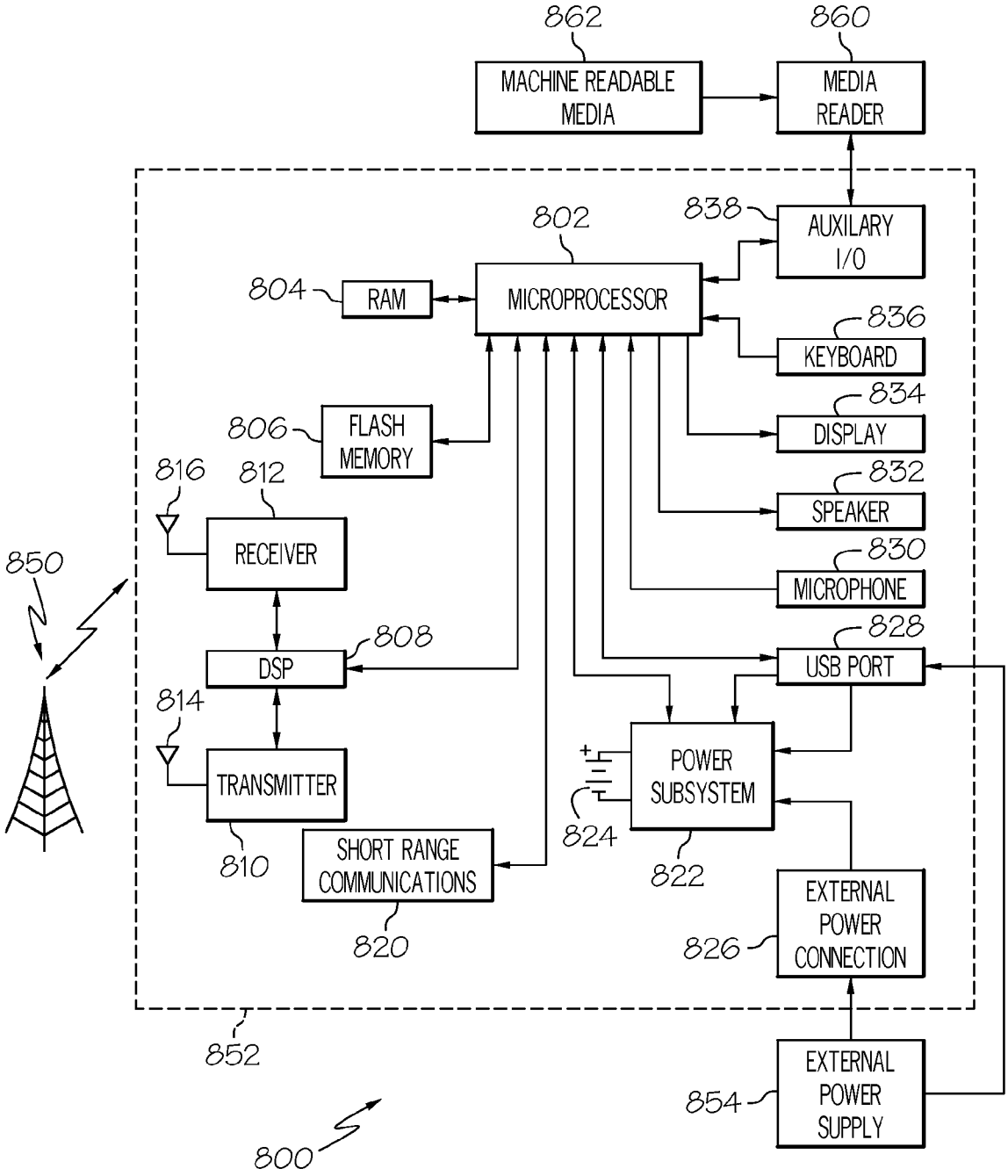
FIG. 8 is a block diagram of an electronic device and associated components in which the systems and methods disclosed herein may be implemented.

FIG. 8 is a block diagram of an electronic device and associated components 800 in which the systems and methods disclosed herein may be implemented. In this example, an electronic device 852 is a wireless two-way communication device with voice and data communication capabilities. Such electronic devices communicate with a wireless voice or data network 850 using a suitable wireless communications protocol. Wireless voice communications are performed using either an analog or digital wireless communication channel. Data communications allow the electronic device 852 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities. A particular example of such an electronic device is the handheld communications device 100, discussed above.

The illustrated electronic device 852 is an example electronic device that includes two-way wireless communications functions. Such electronic devices incorporate communication subsystem elements such as a wireless transmitter 810, a wireless receiver 812, and associated components such as one or more antenna elements 814 and 816. A digital signal processor (DSP) 808 performs processing to extract data from received wireless signals and to generate signals to be transmitted. The particular design of the communication subsystem is dependent upon the communication network and associated wireless communications protocols with which the device is intended to operate.

The electronic device 852 includes a microprocessor 802 that controls the overall operation of the electronic device 852. The microprocessor 802 interacts with the above described communications subsystem elements and also interacts with other device subsystems such as flash memory 806, random access memory (RAM) 804. The flash memory 806 and RAM 804 in one example contain program memory and data memory, respectively. The microprocessor 802 also interacts with an auxiliary input/output (I/O) device 838, a USB Port 828, a display 834, a keyboard 836, a speaker 832, a microphone 830, a short-range communications subsystem 820, a power subsystem 822, and any other device subsystems.

The display 834 in various examples is an OLED based display such as is described above with regards to the display 202. In various examples, the microprocessor 802 performs the above described processing to determine aging compensation values for each pixel, or regions of pixels, within the display 834. These compensation values are applied in one example by processing within microprocessor 802 or a graphics processor (not shown) that is part of the electronic device 852, incorporated into display 834, or located elsewhere.

A battery 824 is connected to a power subsystem 822 to provide power to the circuits of the electronic device 852. The power subsystem 822 includes power distribution circuitry for providing power to the electronic device 852 and also contains battery charging circuitry to manage recharging the battery 824. The power subsystem 822 includes a battery monitoring circuit that is operable to provide a status of one or more battery status indicators, such as remaining capacity, temperature, voltage, electrical current consumption, and the like, to various components of the electronic device 852.

The USB port 828 further provides data communication between the electronic device 852 and one or more external devices. Data communication through USB port 828 enables a user to set preferences through the external device or through a software application and extends the capabilities of the device by enabling information or software exchange through direct connections between the electronic device 852 and external data sources rather then via a wireless data communication network.

Operating system software used by the microprocessor 802 is stored in flash memory 806. Further examples are able to use a battery backed-up RAM or other non-volatile storage data elements to store operating systems, other executable programs, or both. The operating system software, device application software, or parts thereof, are able to be temporarily loaded into volatile data storage such as RAM 804. Data received via wireless communication signals or through wired communications are also able to be stored to RAM 804.

The microprocessor 802, in addition to its operating system functions, is able to execute software applications on the electronic device 852. A predetermined set of applications that control basic device operations, including at least data and voice communication applications, is able to be installed on the electronic device 852 during manufacture. Examples of applications that are able to be loaded onto the device may be a personal information manager (PIM) application having the ability to organize and manage data items relating to the device user, such as, but not limited to, e-mail, calendar events, voice mails, appointments, and task items. Further applications include applications that have input cells that receive data from a user.

Further applications may also be loaded onto the electronic device 852 through, for example, the wireless network 850, an auxiliary I/O device 838, USB port 828, short-range communications subsystem 820, or any combination of these interfaces. Such applications are then able to be installed by a user in the RAM 804 or a non-volatile store for execution by the microprocessor 802.

In a data communication mode, a received signal such as a text message or web page download is processed by the communication subsystem, including wireless receiver 812 and wireless transmitter 810, and communicated data is provided the microprocessor 802, which is able to further process the received data for output to the display 834, or alternatively, to an auxiliary I/O device 838 or the USB port 828. A user of the electronic device 852 may also compose data items, such as e-mail messages, using the keyboard 836, which is able to include a complete alphanumeric keyboard or a telephone-type keypad, in conjunction with the display 834 and possibly an auxiliary I/O device 838. Such composed items are then able to be transmitted over a communication network through the communication subsystem.

For voice communications, overall operation of the electronic device 852 is substantially similar, except that received signals are generally provided to a speaker 832 and signals for transmission are generally produced by a microphone 830. Alternative voice or audio I/O subsystems, such as a voice message recording subsystem, may also be implemented on the electronic device 852. Although voice or audio signal output is generally accomplished primarily through the speaker 832, the display 834 may also be used to provide an indication of the identity of a calling party, the duration of a voice call, or other voice call related information, for example.

Depending on conditions or statuses of the electronic device 852, one or more particular functions associated with a subsystem circuit may be disabled, or an entire subsystem circuit may be disabled. For example, if the battery temperature is low, then voice functions may be disabled, but data communications, such as e-mail, may still be enabled over the communication subsystem.

A short-range communications subsystem 820 is a further optional component which may provide for communication between the electronic device 852 and different systems or devices, which need not necessarily be similar devices. For example, the short-range communications subsystem 820 may include an infrared device and associated circuits and components or a Radio Frequency based communication module such as one supporting Bluetooth® communications, to provide for communication with similarly-enabled systems and devices.

A media reader 860 is able to be connected to an auxiliary I/O device 838 to allow, for example, loading computer readable program code of a computer program product into the electronic device 852 for storage into flash memory 806. One example of a media reader 860 is an optical drive such as a CD/DVD drive, which may be used to store data to and read data from a computer readable medium or storage product such as computer readable storage media 862. Examples of suitable computer readable storage media include optical storage media such as a CD or DVD, magnetic media, or any other suitable data storage device. Media reader 860 is alternatively able to be connected to the electronic device through the USB port 828 or computer readable program code is alternatively able to be provided to the electronic device 852 through the wireless network 850.

Information Processing System

The present subject matter can be realized in hardware, software, or a combination of hardware and software. A system can be realized in a centralized fashion in one computer system, or in a distributed fashion where different elements are spread across several interconnected computer systems. Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein.

The present subject matter can also be embedded in a computer program product, which comprises all the features enabling the implementation of the methods described herein, and which—when loaded in a computer system—is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits. Furthermore, the computer readable medium may comprise computer readable information in a transitory state medium such as a network link and/or a network interface, including a wired network or a wireless network, that allow a computer to read such computer readable information.

One or more of the above described examples provide electronic displays with many benefits and improvements. For example, the above described examples include pixel aging characterization processing that allows pixel aging to be efficiently determined without adding complexity to individual pixel circuit components, and provides an automated and rapid characterization process that requires no user interaction. Some examples perform the characterization using image data that is normally presented on the display, thereby allowing continual or periodic characterization of pixel aging during normal display operation and thereby not using test images in which a user has no interest. Characterizing display aging using images normally presented to a user conserves energy, including battery power, by not using energy to display dedicated test patterns in which the user has no interest. The above described examples efficiently extend the lifespan of a display for producing high quality images by efficiently determining corrections to apply to data to be displayed in order to compensate for display imaging, where the corrections are determined without adding to circuit complexity.

Although specific embodiments of the subject matter have been disclosed, those having ordinary skill in the art will understand that changes can be made to the specific embodiments without departing from the spirit and scope of the disclosed subject matter. The scope of the disclosure is not to be restricted, therefore, to the specific embodiments, and it is intended that the appended claims cover any and all such applications, modifications, and embodiments within the scope of the present disclosure.

What is claimed is:

1. A method for driving a multiple pixel display, the method comprising:

performing any of the following with a processor:

displaying, sequentially in time, a plurality of test pattern images on a multiple pixel display, wherein each test pattern image in the plurality of test pattern images defines respective intensity values for each of at least three pixels, wherein each respective intensity value of the each of the at least three pixels of each test pattern image is different from one another, wherein the respective intensity value in each test pattern image for a particular pixel is different from the respective intensity value of the particular pixel in other test pattern images within the plurality of test pattern images;

determining, while displaying each test pattern image of the plurality of test pattern images, a respective value of measured total electrical current consumed by the multiple pixel display;

determining a plurality of electrical current value differences, each electrical current value difference within the plurality of electrical current value differences comprising a difference between a respective baseline electrical current and the respective value of measured total electrical current, wherein the respective baseline electrical current is associated with a test pattern image displayed while determining the respective value of total electrical current;

determining, based on the plurality of electrical current value differences and the different respective intensity values of each respective pixel of the at least three pixels, a plurality of pixel aging characterization values, each pixel aging characterization value within the a plurality of pixel aging characterization values indicating a respective decrease in electrical current consumed by a corresponding respective pixel within the at least three pixels; and determining, based upon the plurality of pixel aging characterization values, a display aging compensation matrix representing values by which pixel intensity values for the at least three pixels are to be compensated.

2. The method of claim 1, further comprising retrieving, from a data storage prior to the displaying, the plurality of test pattern images.

3. The method of claim 2, further comprising retrieving, prior to determining a respective electrical current value difference within the plurality of electrical current value differences, the respective baseline electrical current from a test pattern total current measurements storage.

4. The method of claim 2, further comprising calculating, subsequent to retrieving each test pattern image within the plurality of test pattern images and prior to determining a respective electrical current value difference within the plurality of electrical current value differences, the respective baseline electrical current based upon combining empirical pixel electrical current consumption characterization data with intensity data of a respective test pattern image associated with the respective electrical current value difference.

5. The method of claim 1, further comprising:

receiving, through an image source interface, a plurality of operational images to be displayed on the multiple pixel display, wherein the plurality of operational images define a sequence of images to be presented to a user, and wherein the plurality of test pattern images comprises the plurality of operational images; and calculating for each operational image received through the image source interface, subsequent to receiving each operational image within the plurality of operational images and prior to determining a respective electrical current value difference within the plurality of electrical current value differences, the respective baseline electrical current based upon combining empirical pixel electrical current consumption characterization data with intensity data of the respective operational image.

6. The method of claim 1, wherein the determining the plurality of pixel aging characterization values comprises:

forming electrical current value difference vector comprising the plurality of electrical current value differences;

forming an intensity definition matrix comprising values, arranged in a first dimension, corresponding to the respective intensity values of each pixel within the at least three pixel defined by each respective test pattern image, and the intensity definition matrix further comprising values, arranged in a second dimension different than the first dimension, corresponding to the intensity values of different test pattern images within the plurality of test pattern images; and solving for a characterization vector based upon a matrix equation expressing an equality of the electrical current value difference vector and a matrix product of the characterization vector and the intensity definition matrix, the characterization vector comprising a plurality of entries each representing a respective reduction in electrical current consumption of at least one respective pixel in the multiple pixel display.

7. The method of claim 1, wherein each pixel aging characterization value within the plurality of pixel aging characterization values characterizes aging of a respective subset plurality of pixels within the multiple pixel display.

8. The method of claim 7, wherein each respective subset plurality of pixels comprises contiguous pixels within the multiple pixel display.

9. A multiple pixel display driving system, comprising:

a display generator configured to display, sequentially in time, a plurality of test pattern images on a multiple pixel display, wherein each test pattern image in the plurality of test pattern images defines respective intensity values for each of at least three pixels, wherein each respective intensity value of the each of the at least three pixels of each test pattern image is different from one another, wherein the respective intensity value in each test pattern image for a particular pixel is different from the respective intensity value of the particular pixel in other test pattern images within the plurality of test pattern images; and an aging monitor configured to:

determine, while the display generator is displaying each test pattern image of the plurality of test pattern images, a respective value of total electrical current consumed by the multiple pixel display;

determine a plurality of electrical current value differences, each electrical current value difference within the plurality of electrical current value differences comprising a difference between a respective baseline electrical current and the respective value of measured total electrical current, wherein the respective baseline electrical current is associated with a test pattern image displayed while determining the respective value of total electrical current;

determine, based on the plurality of electrical current value differences and the different respective intensity values of each respective pixel of the at least three pixels, a plurality of pixel aging characterization values, each pixel aging characterization value within the a plurality of pixel aging characterization values indicating a respective decrease in electrical current consumed by a corresponding respective pixel within the at least three pixels; and determine, based upon the plurality of pixel aging characterization values, a display aging compensation matrix representing values by which pixel intensity values for the at least three pixels are to be compensated.

10. The multiple pixel display driving system of claim 9, further comprising:

a data storage configured to store the plurality of test pattern images; and a test pattern total current measurements storage configured to store a respective baseline electrical current for at least a subset plurality of test pattern images stored in the test pattern images, wherein the aging monitor is further configured to retrieve, from the data storage prior to the displaying, the plurality of test pattern images, and wherein the aging monitor is further configured to retrieve, prior to determining a respective electrical current value difference within the plurality of electrical current value differences, the respective baseline electrical current from the test pattern total current measurements storage.

11. The multiple pixel display driving system of claim 10, the aging monitor further configured to calculate, subsequent to retrieving each test pattern image within the plurality of test pattern images and prior to determining a respective electrical current value difference within the plurality of electrical current value differences, the respective baseline electrical current based upon combining empirical pixel electrical current consumption characterization data with intensity data of a respective test pattern image associated with the respective electrical current value difference.

12. The multiple pixel display driving system of claim 9, further comprising:

an image source interface configured to receive a plurality of operational images to be displayed on the multiple pixel display, wherein the plurality of operational images define a sequence of images to be presented to a user, and wherein the plurality of test pattern images comprises the plurality of operational images, and wherein the aging monitor is further configured to calculate for each operational image received through the image source interface, subsequent to receiving each operational image within the plurality of operational images and prior to determining a respective electrical current value difference within the plurality of electrical current value differences, the respective baseline electrical current based upon combining empirical pixel electrical current consumption characterization data with intensity data of the respective operational image.

13. The multiple pixel display driving system of claim 9, wherein the aging monitor is configured to determine the plurality of pixel aging characterization values by:

forming electrical current value difference vector comprising the plurality of electrical current value differences;

forming an intensity definition matrix comprising values, arranged in a first dimension, corresponding to the respective intensity values of each pixel within the at least three pixel defined by each respective test pattern image, and the intensity definition matrix further comprising values, arranged in a second dimension different than the first dimension, corresponding to the intensity values of different test pattern images within the plurality of test pattern images; and solving for a characterization vector based upon a matrix equation expressing an equality of the electrical current value difference vector and a matrix product of the characterization vector and the intensity definition matrix, the characterization vector comprising a plurality of entries each representing a respective reduction in electrical current consumption of at least one respective pixel in the multiple pixel display.

14. The multiple pixel display driving system of claim 9, wherein each pixel aging characterization value within the plurality of pixel aging characterization values characterizes aging of a respective subset plurality of pixels within the multiple pixel display.

15. The multiple pixel display driving system of claim 14, wherein each respective subset plurality of pixels comprises contiguous pixels within the multiple pixel display.

16. A non-transitory computer readable storage medium having computer readable program code embodied therewith, the computer readable program code comprising instructions for:

displaying, sequentially in time, a plurality of test pattern images on a multiple pixel display, wherein each test pattern image in the plurality of test pattern images defines respective intensity values for each of at least three pixels, wherein each respective intensity value of the each of the at least three pixels of each test pattern image is different from one another, wherein the respective intensity value in each test pattern image for a particular pixel is different from the respective intensity value of the particular pixel in other test pattern images within the plurality of test pattern images;

determining, while displaying each test pattern image of the plurality of test pattern images, a respective value of measured total electrical current consumed by the multiple pixel display;

determining a plurality of electrical current value differences, each electrical current value difference within the plurality of electrical current value differences comprising a difference between a respective baseline electrical current and the respective value of measured total electrical current, wherein the respective baseline electrical current is associated with a test pattern image displayed while determining the respective value of total electrical current;

determining, based on the plurality of electrical current value differences and the different respective intensity values of each respective pixel of the at least three pixels, a plurality of pixel aging characterization values, each pixel aging characterization value within the a plurality of pixel aging characterization values indicating a respective decrease in electrical current consumed by a corresponding respective pixel within the at least three pixels; and determining, based upon the plurality of pixel aging characterization values, a display aging compensation matrix representing values by which pixel intensity values for the at least three pixels are to be compensated.

17. The non-transitory computer readable storage medium of claim 16, the computer readable program code further comprising instructions for retrieving, from a data storage prior to the displaying, the plurality of test pattern images.

18. The non-transitory computer readable storage medium of claim 17, the computer readable program code further comprising instructions for retrieving, prior to determining a respective electrical current value difference within the plurality of electrical current value differences, the respective baseline electrical current from a test pattern total current measurements storage.

19. The non-transitory computer readable storage medium of claim 17, the computer readable program code further comprising instructions for calculating, subsequent to retrieving each test pattern image within the plurality of test pattern images and prior to determining a respective electrical current value difference within the plurality of electrical current value differences, the respective baseline electrical current based upon combining empirical pixel electrical current consumption characterization data with intensity data of a respective test pattern image associated with the respective electrical current value difference.

20. The non-transitory computer readable storage medium of claim 16, the computer readable program code further comprising instructions for:

receiving, through an image source interface, a plurality of operational images to be displayed on the multiple pixel display, wherein the plurality of operational images define a sequence of images to be presented to a user, and wherein the plurality of test pattern images comprises the plurality of operational images; and calculating for each operational image received through the image source interface, subsequent to receiving each operational image within the plurality of operational images and prior to determining a respective electrical current value difference within the plurality of electrical current value differences, the respective baseline electrical current based upon combining empirical pixel electrical current consumption characterization data with intensity data of the respective operational image.

21. The non-transitory computer readable storage medium of claim 16, wherein the instructions for determining the plurality of pixel aging characterization values comprises instructions for:

forming electrical current value difference vector comprising the plurality of electrical current value differences;

forming an intensity definition matrix comprising values, arranged in a first dimension, corresponding to the respective intensity values of each pixel within the at least three pixel defined by each respective test pattern image, and the intensity definition matrix further comprising values, arranged in a second dimension different than the first dimension, corresponding to the intensity values of different test pattern images within the plurality of test pattern images; and solving for a characterization vector based upon a matrix equation expressing an equality of the electrical current value difference vector and a matrix product of the characterization vector and the intensity definition matrix, the characterization vector comprising a plurality of entries each representing a respective reduction in electrical current consumption of at least one respective pixel in the multiple pixel display.

22. The non-transitory computer readable storage medium of claim 16, wherein each pixel aging characterization value within the plurality of pixel aging characterization values characterizes aging of a respective subset plurality of pixels within the multiple pixel display.

23. The non-transitory computer readable storage medium of claim 22, wherein each respective subset plurality of pixels comprises contiguous pixels within the multiple pixel display.

24. An electronic display device comprising:

a multiple pixel display;

a display generator configured to display, sequentially in time, a plurality of test pattern images on a multiple pixel display, wherein each test pattern image in the plurality of test pattern images defines respective intensity values for each of at least three pixels, wherein each respective intensity value of the each of the at least three pixels of each test pattern image is different from one another, wherein the respective intensity value in each test pattern image for a particular pixel is different from the respective intensity value of the particular pixel in other test pattern images within the plurality of test pattern images; and an aging monitor configured to:

determine, while the display generator is displaying each test pattern image of the plurality of test pattern images, a respective value of total electrical current consumed by the multiple pixel display;

determine a plurality of electrical current value differences, each electrical current value difference within the plurality of electrical current value differences comprising a difference between a respective baseline electrical current and the respective value of measured total electrical current, wherein the respective baseline electrical current is associated with a test pattern image displayed while determining the respective value of total electrical current;

determine, based on the plurality of electrical current value differences and the different respective intensity values of each respective pixel of the at least three pixels, a plurality of pixel aging characterization values, each pixel aging characterization value within the a plurality of pixel aging characterization values indicating a respective decrease in electrical current consumed by a corresponding respective pixel within the at least three pixels; and determine, based upon the plurality of pixel aging characterization values, a display aging compensation matrix representing values by which pixel intensity values for the at least three pixels are to be compensated.

25. The method of claim 5, wherein the plurality of operational images define a video to be presented to the user.

* * * * *